US010677041B2

(12) United States Patent
Chugunov et al.

(10) Patent No.: US 10,677,041 B2
(45) Date of Patent: Jun. 9, 2020

(54) FAULT DETECTION IN ELECTRIC SUBMERSIBLE PUMPS

(71) Applicant: Sensia LLC, Houston, TX (US)

(72) Inventors: Nikita Chugunov, Arlington, MA (US); Sandeep Verma, Acton, MA (US); Sandip Bose, Brookline, MA (US)

(73) Assignee: Sensia LLC, Houston, TX (US)

( * ) Notice: Subject to any disclaimer, the term of this patent is extended or adjusted under 35 U.S.C. 154(b) by 491 days.

(21) Appl. No.: 15/314,898

(22) PCT Filed: Jun. 15, 2015

(86) PCT No.: PCT/US2015/035765

§ 371 (c)(1),
(2) Date: Nov. 29, 2016

(87) PCT Pub. No.: WO2015/195520

PCT Pub. Date: Dec. 23, 2015

(65) Prior Publication Data

US 2017/0122094 A1 May 4, 2017

Related U.S. Application Data

(60) Provisional application No. 62/012,867, filed on Jun. 16, 2014.

(51) Int. Cl.
*E21B 47/00* (2012.01)
*F04D 15/00* (2006.01)
(Continued)

(52) U.S. Cl.
CPC ..... *E21B 47/0007* (2013.01); *E21B 43/128* (2013.01); *F04D 13/10* (2013.01); *F04D 15/0077* (2013.01); *F04D 15/0088* (2013.01)

(58) Field of Classification Search
CPC .... E21B 47/0007; E21B 43/128; F04D 13/10; F04D 15/0077; F04D 15/0088
See application file for complete search history.

(56) References Cited

U.S. PATENT DOCUMENTS 6,952,657 B2 10/2005 Jahns et al.
7,024,335 B1 4/2006 Parlos
(Continued)

OTHER PUBLICATIONS

PCT/US2015/035765 International Search Report and Written Opinion, dated Sep. 14, 2015, 8 pgs.

*Primary Examiner* — Yoshihisa Ishizuka
(74) *Attorney, Agent, or Firm* — Foley & Lardner LLP

(57) ABSTRACT

A method for monitoring performance of an electric submersible pump. The method includes receiving data indicating a plurality of observable parameters from one or more sensors, generating a reduced set of components representative of at least some of the observable parameters and the reduced set having a dimensionality less than the plurality of observable parameters, identifying one or more components of the reduced set that captures a total variance of the plurality of observable parameters above a predetermined threshold, constructing at least one manifold of normal operation of the electric submersible pump in a reduced component space, receiving additional data from the sensors, transforming the additional data into the identified components establishing an electric submersible pump performance, and detecting whether a deviation of the electric submersible pump performance from a normal mode of operation of the electric submersible pump exceeds a predetermined threshold.

22 Claims, 8 Drawing Sheets

(51) Int. Cl.
*F04D 13/10* (2006.01)
*E21B 43/12* (2006.01)

(56) References Cited

U.S. PATENT DOCUMENTS

| | | | | |
|---|---|---|---|---|
| 7,043,348 | B2 | 5/2006 | Onder et al. | |
| 7,114,557 | B2 | 10/2006 | Cudmore et al. | |
| 7,243,048 | B2 | 7/2007 | Foslien et al. | |
| 7,421,351 | B2 | 9/2008 | Navratil | |
| 7,711,486 | B2 | 5/2010 | Thigpen et al. | |
| 7,730,967 | B2 | 6/2010 | Ballantyne et al. | |
| 7,801,707 | B2 | 9/2010 | Bailey et al. | |
| 7,979,240 | B2 | 7/2011 | Fielder | |
| 8,041,539 | B2 | 10/2011 | Guralnik et al. | |
| 8,301,333 | B2 | 10/2012 | Singh et al. | |
| 2007/0175633 | A1 | 8/2007 | Kosmala et al. | |
| 2015/0226058 | A1* | 8/2015 | Stolpman | E21B 47/18 702/9 |
| 2015/0308191 | A1* | 10/2015 | Zhan | E21B 12/02 703/2 |
| 2015/0356521 | A1* | 12/2015 | Sridhar | G06Q 50/04 705/305 |

* cited by examiner

FAULT DETECTION IN ELECTRIC SUBMERSIBLE PUMPS

CROSS-REFERENCE TO RELATED APPLICATIONS

The present application claims priority to U.S. Provisional Application No. 62/012,867 filed Jun. 16, 2014, entitled "Methods for Fault Detection in Electric Submersible Pumps," which is incorporated herein by reference in its entirety for all purposes.

STATEMENT REGARDING FEDERALLY SPONSORED RESEARCH OR DEVELOPMENT

Not applicable.

BACKGROUND

Electric submersible pumps (ESPs) may be deployed for any of a variety of pumping purposes. For example, where a substance (e.g., hydrocarbons in an earthen formation) does not readily flow responsive to existing natural forces, an ESP may be implemented to artificially lift the substance. If an ESP fails during operation, the ESP must be removed from the pumping environment and replaced or repaired, either of which results in a significant cost to an operator. The ability to predict an ESP failure and/or detect early warning signs, for example by monitoring the operating conditions and parameters of the ESP, provides the operator with the ability to perform preventative maintenance on the ESP or replace the ESP in an efficient manner, reducing the cost to the operator.

Conventional approaches to gauging ESP performance include standard two-dimensional performance curves. FIG. 1 shows typical ESP performance curves. Commonly used two-dimensional curves include head (in height of water column) versus flow rate 102 across the ESP for various rotational speeds, power (hp) versus flow rate 104, and pump efficiency versus flow rate 106. Operators are provided these curves from the manufacturer and performance degradation is measured by the operational envelope or operating point deviating from the standard performance curves. For example, if an operator plots a performance point on any of these plots after operation of the ESP for some time in the field, currently, one of the only ways of gauging performance issues with the ESP is if the operating point deviates or falls below the expected efficiency, or head for a certain flow rate. Alternatively, the expected power requirement (in hp) could be higher (than predicted by the standard performance curve) for the same flow rate.

SUMMARY

Embodiments of the present disclosure are directed to a method for monitoring an electric submersible pump. The method includes receiving data indicating a plurality of observable parameters from sensors and generating a reduced set of components representative of at least some of the observable parameters. The reduced set of components has a dimensionality less than the plurality of observable parameters. The method also includes identifying components of the reduced set that capture a total variance of the plurality of observable parameters above a threshold and constructing a manifold of normal operation of the electric submersible pump in a reduced component space. Further, the method includes receiving additional data from the sensors, transforming the additional data into the identified components to establish an electric submersible pump performance, and detecting whether a deviation of the electric submersible pump performance from a normal mode of operation of the electric submersible pump exceeds a threshold.

Other embodiments of the present disclosure are directed to a system for monitoring an electric submersible pump. The system includes sensors to generate data indicative of a plurality of observable parameters and a processor coupled to the sensors. The processor receives the data from the sensors and generates a reduced set of components representative of at least some of the observable parameters. The reduced set of components has a dimensionality less than the plurality of observable parameters. The processor also identifies components of the reduced set that capture a total variance of the plurality of observable parameters above a threshold and constructs a manifold of normal operation of the electric submersible pump in a reduced component space. Further, the processor receives additional data from the sensors, transforms the additional data into the identified components establishing an electric submersible pump performance, and detects whether a deviation of the electric submersible pump performance from a normal mode of operation of the electric submersible pump exceeds a threshold.

Still other embodiments of the present disclosure are directed to a non-transitory computer-readable medium containing instructions that, when executed by a processor, cause the processor to receive data indicative of a plurality of observable parameters from sensors and generate a reduced set of components representative of at least some of the observable parameters. The reduced set has a dimensionality less than the plurality of observable parameters. The instructions further cause the processor to identify components of the reduced set that capture a total variance of the plurality of observable parameters above a threshold and construct a manifold of normal operation of the electric submersible pump in a reduced component space. Further, the instructions cause the processor to receive additional data from the sensors, transform the additional data into the identified components establishing an electric submersible pump performance, and detect whether a deviation of the electric submersible pump performance from a normal mode of operation of the electric submersible pump exceeds a threshold.

The foregoing has outlined rather broadly a selection of features of the disclosure such that the detailed description of the disclosure that follows may be better understood. This summary is not intended to identify key or essential features of the claimed subject matter, nor is it intended to be used as an aid in limiting the scope of the claimed subject matter.

BRIEF DESCRIPTION OF THE DRAWINGS

Embodiments of the disclosure are described with reference to the following figures.

DETAILED DESCRIPTION

Figure 1:
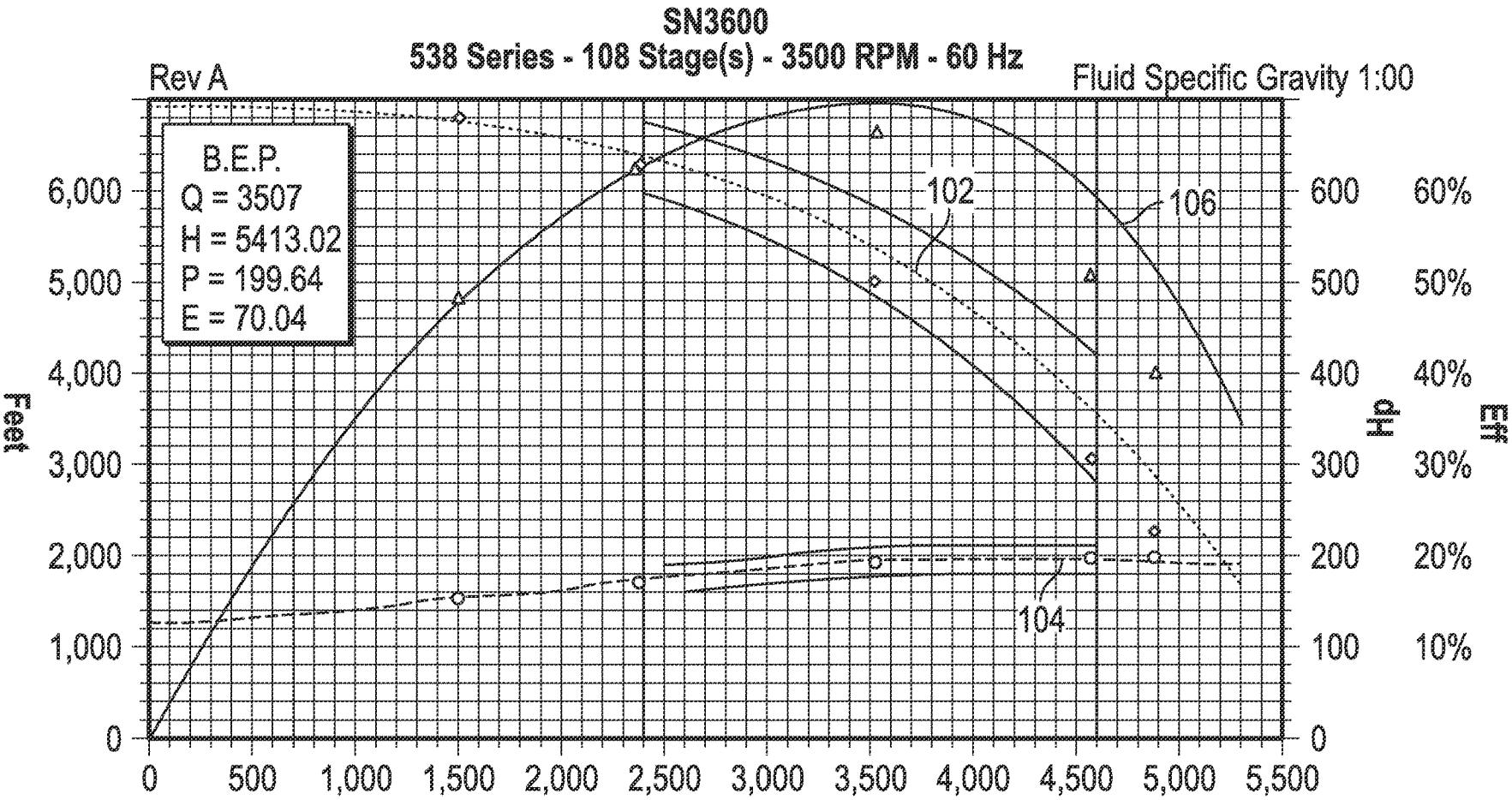
FIG. 1 (Prior Art)
FIG. 1 illustrates an example of prior art electric submersible pump performance curves.

One or more embodiments of the present disclosure are described below. These embodiments are merely examples of the presently disclosed techniques. Additionally, in an effort to provide a concise description of these embodiments, all features of an actual implementation may not be described in the specification. It should be appreciated that in the development of any such implementation, as in any engineering or design project, numerous implementation-specific decisions are made to achieve the developers' specific goals, such as compliance with system-related and business-related constraints, which may vary from one implementation to another. Moreover, it should be appreciated that such development efforts might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The embodiments discussed below are intended to be examples that are illustrative in nature and should not be construed to mean that the specific embodiments described herein are necessarily preferential in nature. Additionally, it should be understood that references to "one embodiment" or "an embodiment" within the present disclosure are not to be interpreted as excluding the existence of additional embodiments that also incorporate the recited features. The drawing figures are not necessarily to scale. Certain features and components disclosed herein may be shown exaggerated in scale or in somewhat schematic form, and some details of conventional elements may not be shown in the interest of clarity and conciseness.

The terms "including" and "comprising" are used herein, including in the claims, in an open-ended fashion, and thus should be interpreted to mean "including, but not limited to . . . ." Also, the term "couple" or "couples" is intended to mean either an indirect or direct connection. Thus, if a first component couples or is coupled to a second component, the connection between the components may be through a direct engagement of the two components, or through an indirect connection that is accomplished via other intermediate components, devices and/or connections. If the connection transfers electrical power or signals, the coupling may be through wires or other modes of transmission. In some of the figures, one or more components or aspects of a component may be not displayed or may not have reference numerals identifying the features or components that are identified elsewhere in order to improve clarity and conciseness of the figure.

Electric submersible pumps (ESPs) may be deployed for any of a variety of pumping purposes. For example, where a substance does not readily flow responsive to existing natural forces, an ESP may be implemented to artificially lift the substance. Commercially available ESPs (such as the REDA™ ESPs marketed by Schlumberger Limited, Houston, Tex.) may find use in applications that require, for example, pump rates in excess of 4,000 barrels per day and lift of 12,000 feet or more.

To improve ESP operations, an ESP may include one or more sensors (e.g., gauges) that measure any of a variety of physical properties (e.g., temperature, pressure, vibration, etc.). A commercially available sensor is the Phoenix MultiSensor™ marketed by Schlumberger Limited (Houston, Tex.), which monitors intake and discharge pressures; intake, motor and discharge temperatures; and vibration and current leakage. An ESP monitoring system may include a supervisory control and data acquisition system (SCADA). Commercially available surveillance systems include the espWatcher™ and the LiftWatcher™ surveillance systems marketed by Schlumberger Limited (Houston, Tex.), which provides for communication of data, for example, between a production team and well/field data (e.g., with or without SCADA installations). Such a system may issue instructions to, for example, start, stop, or control ESP speed via an ESP controller.

The conventional method for gauging ESP performance explained above only monitors a small number of parameters represented as two-dimensional performance curves. As a result, certain errors that might not correlate to a large deviation in any of the performance curves 102, 104, 106 may go unnoticed. Further, once a deviation in any of the performance curves 102, 104, 106 is deemed to be outside of a normal operating envelope, it may already be too late to take any corrective action to remedy the ESP issue.

To overcome these deficiencies of conventional two-dimensional performance curve analysis, and in accordance with various embodiments of the present disclosure, systems and methods are described in which a plurality of observable parameters related to ESP operation are mapped to a reduced set of components. The term "component" represents a mathematical construct used to combine a number of observable parameters into a single quantity; in at least some examples, a component is a linear combination of various ones of the observable parameters. As used herein, "reduced set" refers to the fact that the set has a dimensionality less than the number of observable parameters. For example, where 10 observable parameters are being measured and recorded, the reduced set of components might include three components. Certain ones of the set of components may be identified that, taken in sum, capture a total variance of the plurality of observable parameters above a predetermined threshold. For example, if the predetermined threshold is 80% and a first component contributes 65%, while a second component contributes 20%, and a third component contributes 5%, the first and second components are identified since their combination contributes 85% of the total variance. The foregoing is merely exemplary, and in practice any combination of components that satisfies a predetermined threshold may be utilized.

Subsequently, additional data indicative of at least some of the plurality of observable parameters is received, which is transformed or mapped to the identified set of components. This may be referred to as establishing an ESP performance metric and can be thought of as a coordinate in a space defined by the identified components. In some embodiments, the components are derived using principal component analysis (PCA), and thus are principal components, and the defined space is a principal component space. A manifold or envelope is defined within the space or principal component space, which outlines a region corresponding to a normal mode of operation of the ESP. Thus, it can be detected whether a deviation of the ESP performance metric (i.e., a coordinate in the space) from a normal mode of operation of the ESP exceeds a predetermined threshold. In some embodiments, the normal mode of operation is defined as the origin of the space or principal component space and a region defined by distance away from the origin, in which the distance may be dependent on the direction from the origin. In another embodiment, classification or clustering (such as k-means clustering, Bayesian hierarchical clustering) can be performed to identify clusters (in principal component space) of observations representing normal mode of ESP operation, and determine degree of similarity between the new observation and the clusters of normal mode of ESP operation.

In this way, a large number of observable parameters may be reduced to a set of components that still demonstrates a large contribution to the total variance of the parameters, but is computationally simpler to process. As a result, parameters that were previously ignored or thought insignificant in predicting ESP performance—such as those parameters not utilized in conventional performance curves as in FIG. 1—may be considered in determining pump performance. Similarly, deviations in parameter value that were not captured by conventional performance curves may be considered by embodiments of the present disclosure, leading to an enhanced ability to predict pump performance without unduly increasing processing requirements.

Figure 2:
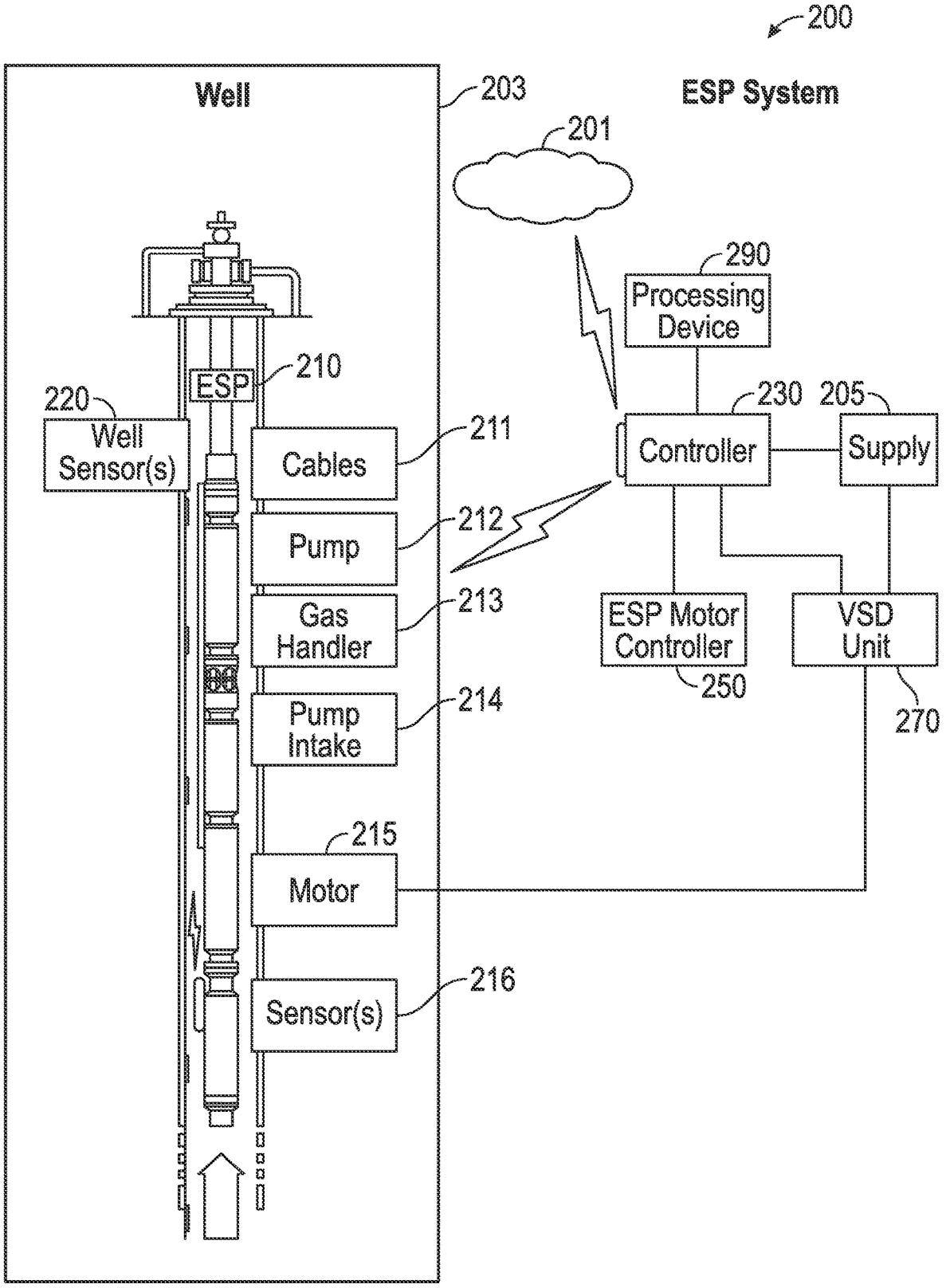
FIG. 2 illustrates an exemplary electric submersible pump system in accordance with various embodiments of the present disclosure.

Referring now to FIG. 2, an example of an ESP system 200 is shown. The ESP system 200 includes a network 201, a well 203 disposed in a geologic environment, a power supply 205, an ESP 210, a controller 230, a motor controller 250, and a variable speed drive (VSD) unit 270. The power supply 205 may receive power from a power grid, an onsite generator (e.g., a natural gas driven turbine), or other source. The power supply 205 may supply a voltage, for example, of about 4.16 kV.

The well 203 includes a wellhead that can include a choke (e.g., a choke valve). For example, the well 203 can include a choke valve to control various operations such as to reduce pressure of a fluid from high pressure in a closed wellbore to atmospheric pressure. Adjustable choke valves can include valves constructed to resist wear due to high velocity, solids-laden fluid flowing by restricting or sealing elements. A wellhead may include one or more sensors such as a temperature sensor, a pressure sensor, a solids sensor, and the like.

The ESP 210 includes cables 211, a pump 212, gas handling features 213, a pump intake 214, a motor 215 and one or more sensors 216 (e.g., temperature, pressure, current leakage, vibration, etc.). The well 203 may include one or more well sensors 220, for example, such as the commercially available OpticLine™ sensors or WellWatcher BriteBlue™ sensors marketed by Schlumberger Limited (Houston, Tex.). Such sensors are fiber-optic based and can provide for real time sensing of downhole conditions. Measurements of downhole conditions along the length of the well can provide for feedback, for example, to understand the operating mode or health of an ESP. Well sensors may extend thousands of feet into a well (e.g., 4,000 feet or more) and beyond a position of an ESP.

The controller 230 can include one or more interfaces, for example, for receipt, transmission or receipt and transmission of information with the motor controller 250, a VSD unit 270, the power supply 205 (e.g., a gas fueled turbine generator or a power company), the network 201, equipment in the well 203, equipment in another well, and the like. The controller 230 may also include features of an ESP motor controller and optionally supplant the ESP motor controller 250.

The motor controller 250 may be a commercially available motor controller such as the UniConn™ motor controller marketed by Schlumberger Limited (Houston, Tex.). The UniConn™ motor controller can connect to a SCADA system, the espWatcher™ surveillance system, etc. The UniConn™ motor controller can perform some control and data acquisition tasks for ESPs, surface pumps, or other monitored wells. The UniConn™ motor controller can interface with the Phoenix™ monitoring system, for example, to access pressure, temperature, and vibration data and various protection parameters as well as to provide direct current power to downhole sensors. The UniConn™ motor controller can interface with fixed speed drive (FSD) controllers or a VSD unit, for example, such as the VSD unit 270.

In accordance with various examples of the present disclosure, the controller 230 may include or be coupled to a processing device 290. Thus, the processing device 290 is able to receive data from ESP sensors 216 and/or well sensors 220. As will be explained in further detail below, the processing device 290 analyzes the data received from the sensors 216 and/or 220 to more accurately predict performance of the ESP 210 or whether a fault of the ESP 210 is likely to occur. The prediction of performance of the ESP 210 may be presented to a user through a display device (not shown) coupled to the processing device 290, through a user device (not shown) coupled to the network 201, or other similar manners.

In some embodiments, the network 201 comprises a cellular network and the user device is a mobile phone, a smartphone, or the like. In these embodiments, the prediction or identification of performance of the ESP 210 may be transmitted to one or more users physically remote from the ESP system 200 over the cellular network 201. In some embodiments, the prediction of performance may be that the ESP 210 is expected to remain in its normal operating mode, or may be a warning of varying severity that a fault, failure, or degradation in ESP 210 performance is expected.

Regardless of the type of prediction of ESP 210 performance, certain embodiments of the present disclosure may include taking a remedial or other corrective action in response to a determination that the ESP 210 is expected to fail or experience degraded performance. The action taken may be automated in some instances, such that a particular type of determination automatically results in the action being carried out. Actions taken may include altering ESP 210 operating parameters (e.g., operating frequency) or surface process parameters (e.g., choke or control valves) to prolong ESP 210 operational life, stopping the ESP 210 temporarily and providing a warning to a local operator, control room, or a regional surveillance center.

Figure 3:
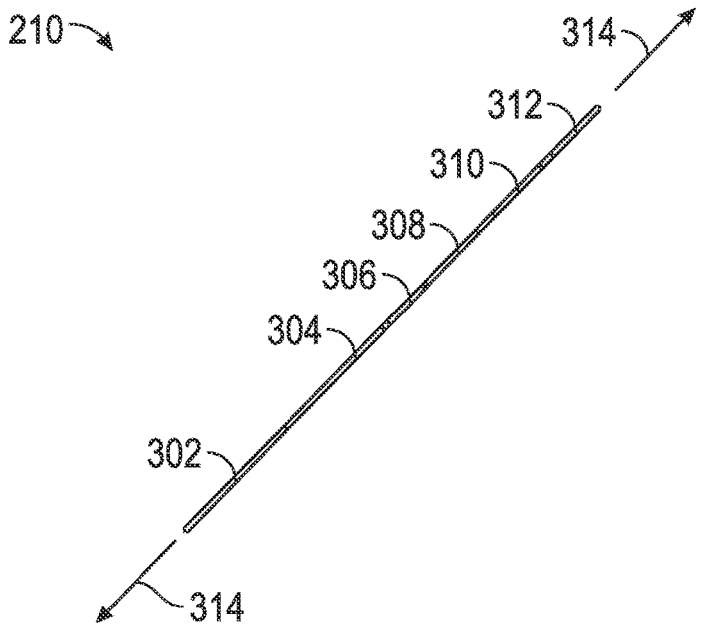
FIG. 3 illustrates various exemplary components of an electric submersible pump in accordance with various embodiments of the present disclosure.

FIG. 3 shows a simplified schematic of an exemplary and non-limiting ESP 210. In this example, observable parameters such as electro-mechanical data related to the ESP 210 may be acquired during a normal mode of operation. In certain cases, the observable parameters may be obtained in a controlled environment to determine a manifold or envelope of the normal mode of operation of the ESP 210. As shown in FIG. 3, the ESP 210 includes two motors, lower tandem (LT) motor 302 and upper tandem (UT) motor 304; two protectors, LT protector 306 and UT protector 308; and two pumps, labeled LT pump 310 and UT pump 312, all on a common shaft 314. Although two of each component is depicted in FIG. 3, other embodiments are contemplated including an ESP 210 comprising one motor, one protector, and one pump. In certain examples, the ESP 210 string is tested in a water-filled well while suspended just below ground level.

In one non-limiting example, the observed parameter space comprises a plurality of parameters, such as surface flow rate, pump inlet/discharge pressures, motor temperatures, protector temperatures, motor lead temperatures, vibration along various axes, power consumption, and the like.

Of course, various embodiments of the present disclosure also include the attendant sensors or methods of sensing the above parameters. Additionally, the above list is neither required nor exhaustive, and any number of observable parameters related to ESP 210 operation may be monitored in the alternative. In one experimental scenario, control parameters including electric power and frequency were varied, while ESP 210 operation, that is the above observable parameters, were monitored over the course of 72 hours with approximately 48 data points recorded for each observable parameter and control parameter.

Figure 4:
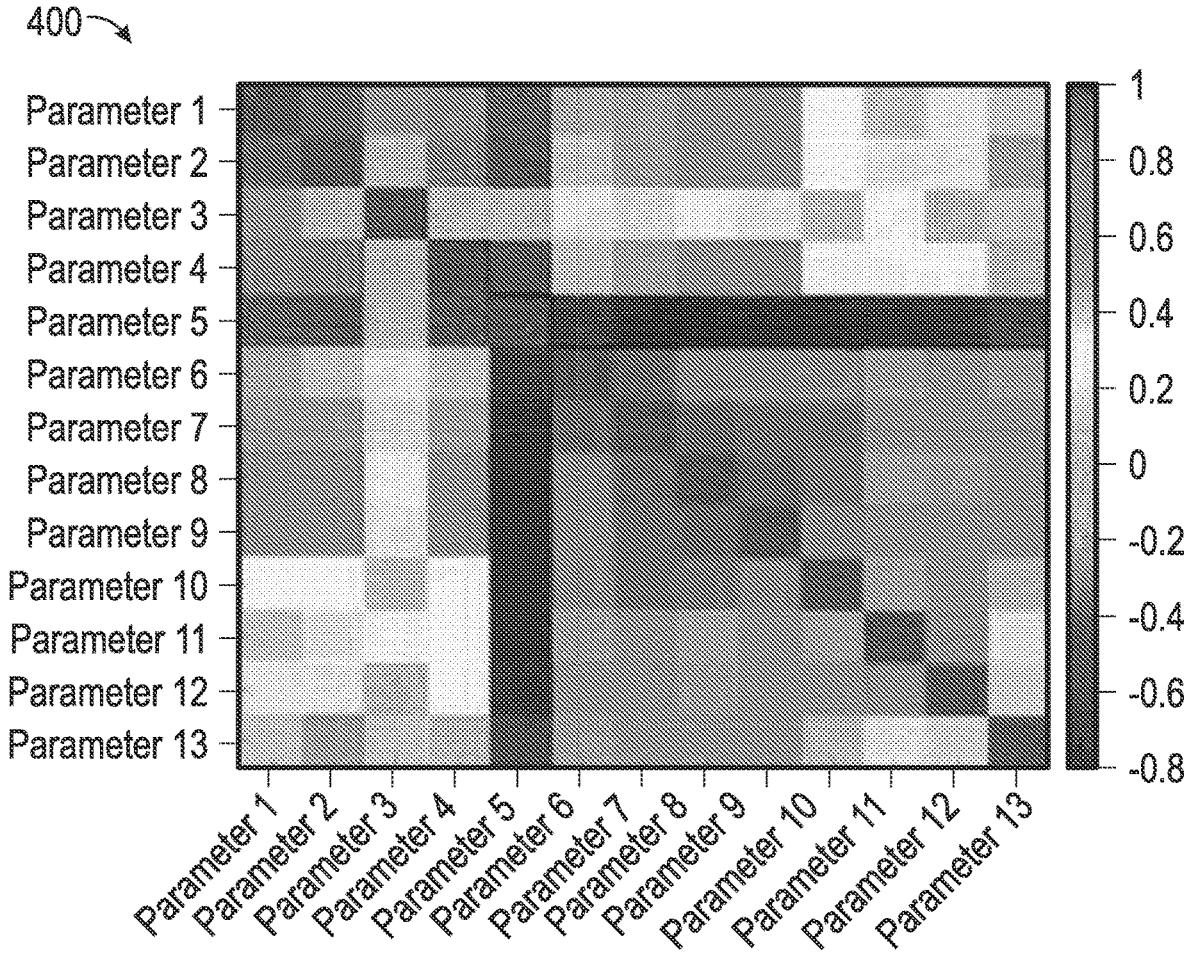
FIG. 4 illustrates an exemplary cross-correlation matrix of control parameters and observable parameters in accordance with various embodiments of the present disclosure.

FIG. 4 shows a cross-correlation matrix of control parameters and observable parameters 400. Parameters 1-13 may correspond to any of the above exemplary parameters as well as any observable parameter related to ESP 210 operation. As can be seen, a negative correlation with respect to all other parameters is observed for Parameter 5. Conversely, a high correlation is observed for Parameter 1 versus Parameter 2. Additionally, a strong cross-correlation exists for a group of variables in the center of the matrix including Parameters 6-9.

In accordance with various embodiments of the present disclosure, an analysis such as Principal component analysis (PCA), may be performed on the observed parameter space. Taking PCA as an example, an orthogonal set of new variables is constructed, which are linear combinations of the original observed parameters. Since the observed variables correspond to different physical quantities and are expressed in different units, scaling of the original data is performed prior to PCA using inverse variance of the original data. As shown, for example, the data is scaled to a range from −1 to 1.

Figure 5:
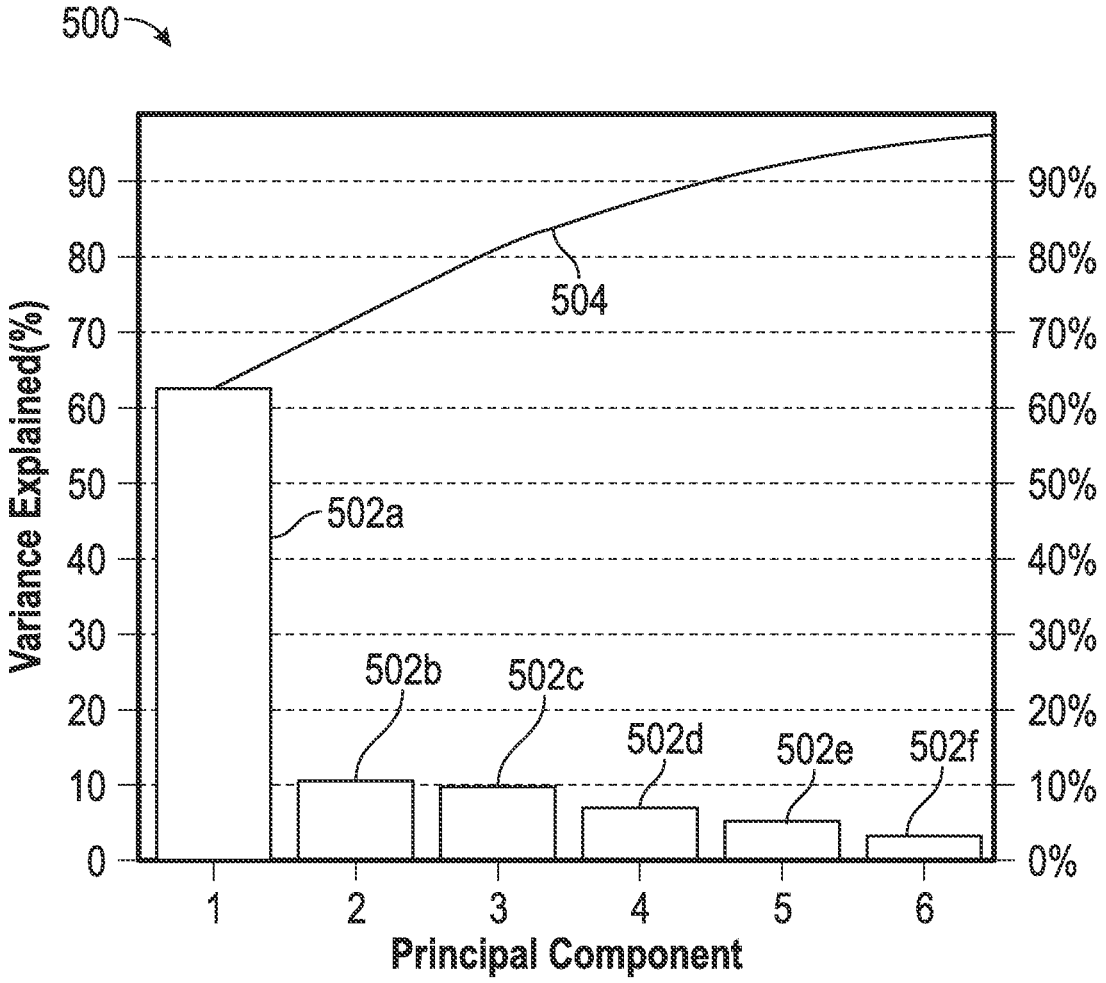
FIG. 5 illustrates a principal component analysis variance diagram in accordance with various embodiments of the present disclosure.

FIG. 5 shows a PCA variance diagram 500 showing the individual 502*a-f* and cumulative amount 504 of total variance explained by the principal components. In the depicted example, the first principal component 502*a* alone explains more than 60% of total variance, while first three principal components 502*a-c* explain more than 80% of the total variance. Finally, more than 95% of total variance is explained by the first six principal components 502*a-f*. As explained above, even employing the first six principal components 502*a-f*, a set of components having greatly reduced dimensionality relative to the observed parameters (i.e., dimensionality of 11) is obtained, while explaining a high degree of the total variance of those observed parameters.

Figure 6:
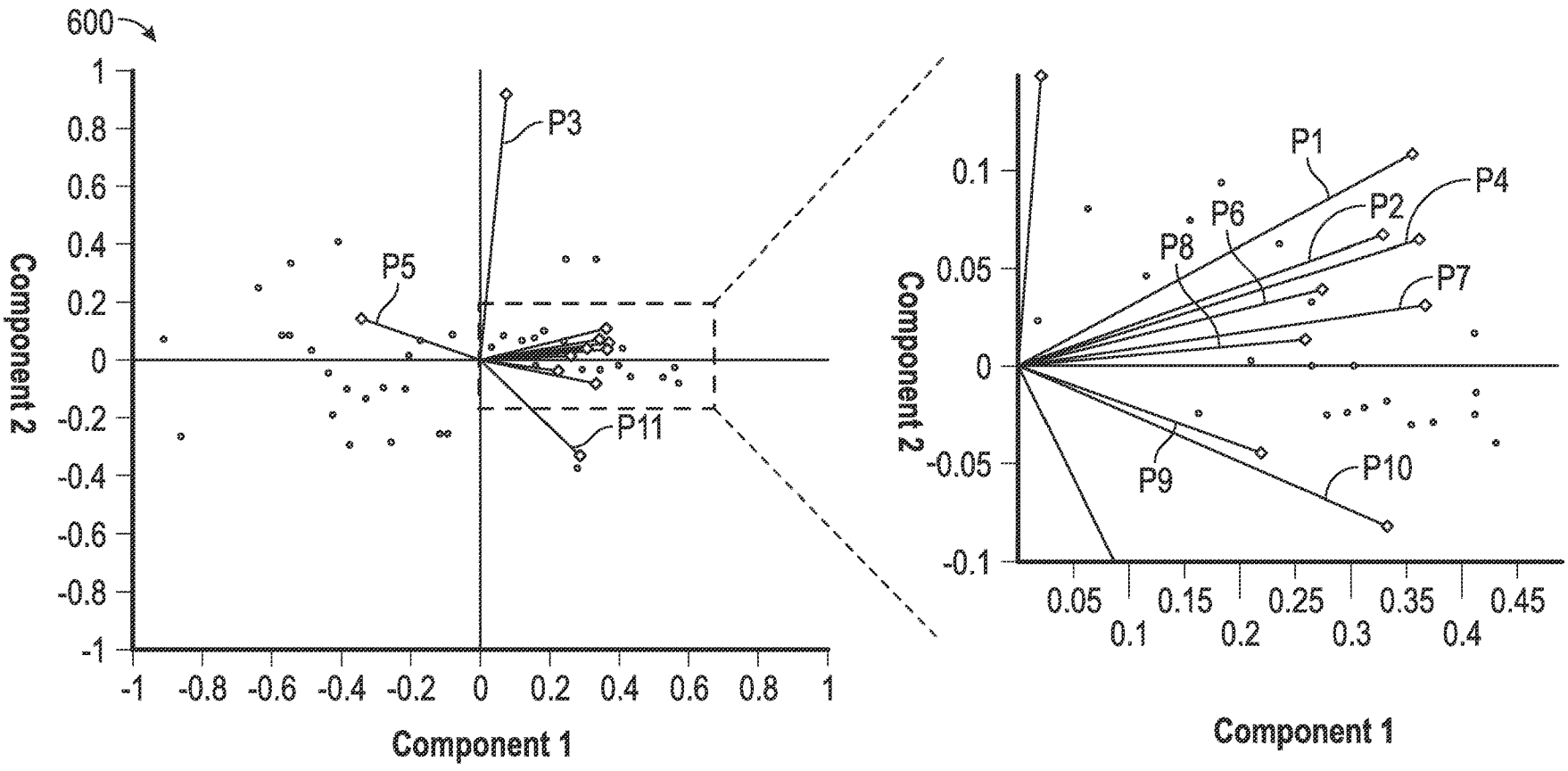
FIGS. 6-8 illustrate principal component analysis bi-plots that demonstrate the relation between an observed parameter space and a principal component space in accordance with various embodiments of the present disclosure.
Figure 7:
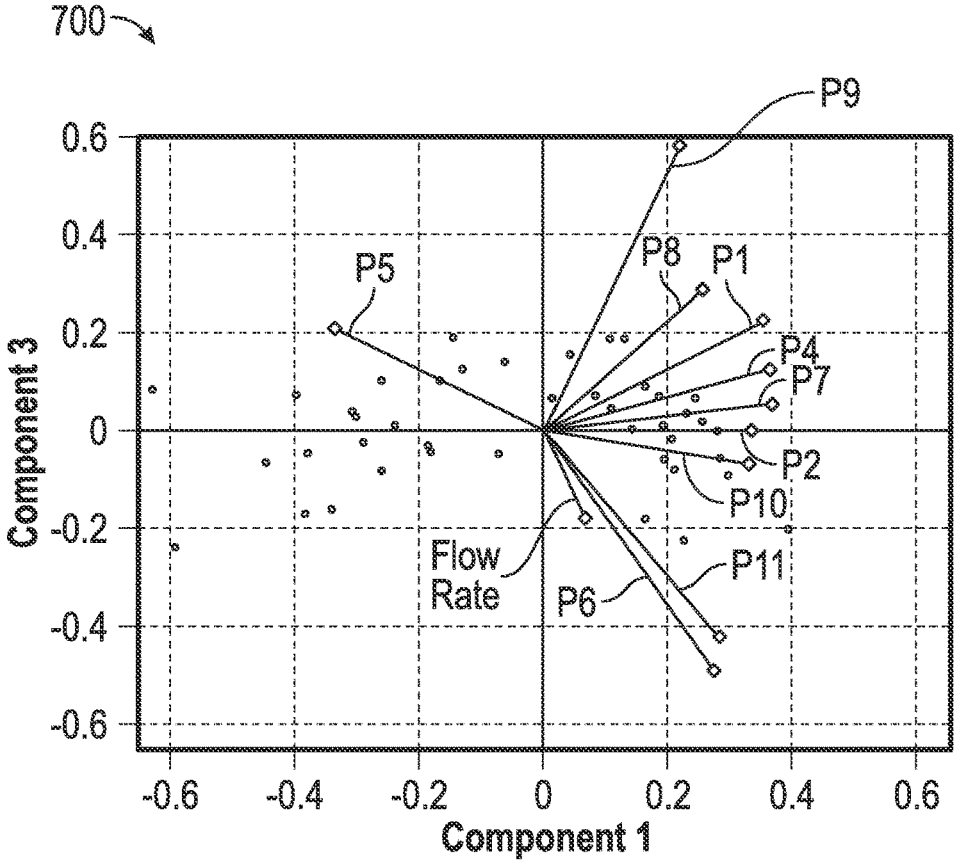
Figure 8:
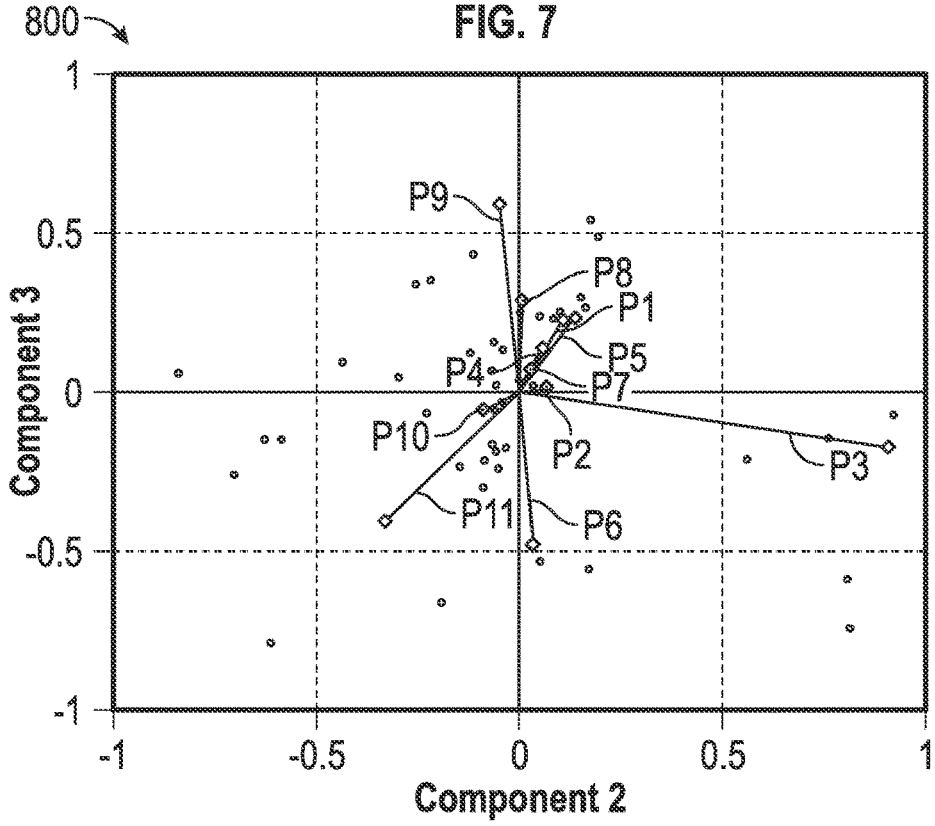

FIGS. 6-8 demonstrate the various relations between the original observed parameter space and the principal component using PCA bi-plots 600, 700, 800. The bi-plot 600 in FIG. 6 shows the observed parameters plotted in the axis corresponding to first two principal components. That is, eleven original observed parameters (P1-P11) are represented in this bi-plot by a vector, and the direction and length of the vector indicate how each observed parameter contributes to each of the two principal components in the plot. For example, parameter P3 is nearly orthogonal to principal component 1 (PC1), suggesting that P3 contributes minimally to PC1, but also represents a strong positive contribution to principal component 2 (PC2). As another example, the parameter P5 is the only parameter having a negative contribution to PC1. As indicated in FIG. 5, PC1 represents a large percent contribution to the total variance of the observed parameters, which is manifested in the bi-plot 600 in which a majority of the observed parameters are well-aligned with PC1, while having relatively small projections on the PC2 axis.

FIG. 7 shows the bi-plot 700 for the observed parameters plotted in the axis corresponding to PC1 and principal component 3 (PC3). As can be seen, parameter P6 and parameter P11 provide the most significant negative contribution when projected on PC3. Finally, FIG. 8 shows the bi-plot 800 for PC2 and PC3. Comparing the bi-plot 800 to bi-plots 600, 700, it is noted that PC3 adds better discrimination for variables not well-represented by PC1 and PC2 (e.g., parameter P9 and parameter P6).

Figure 9:
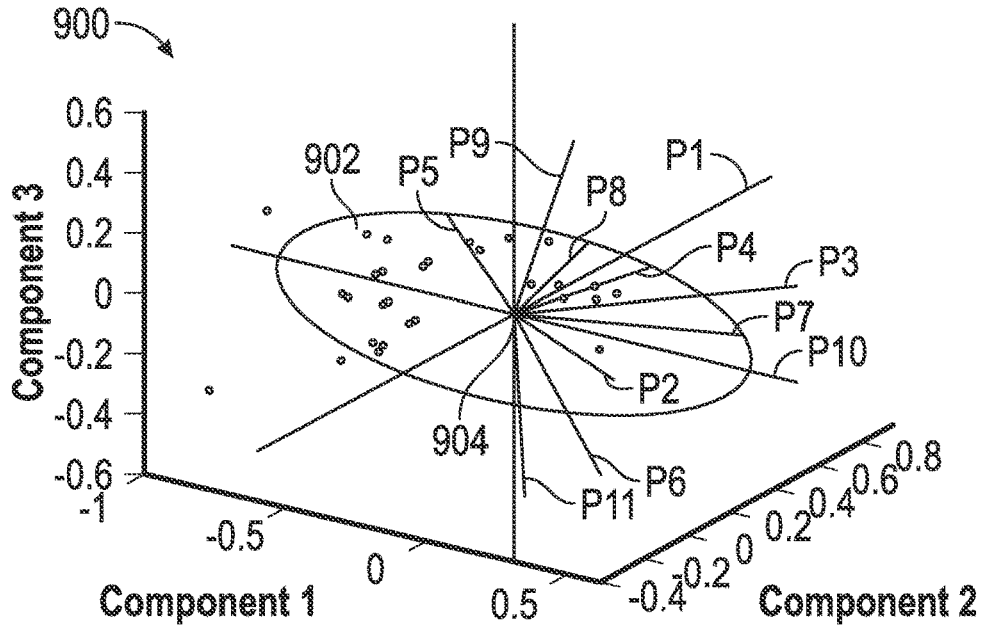
FIG. 9 illustrates a combined principal component analysis plot including a graphic representation of a normal operation manifold in accordance with various embodiments of the present disclosure.

FIG. 9 shows a combined PCA plot 900 for first three principal components. The combined plot 900 can be used to graphically define a normal operation manifold 902 for ESP 210. In certain embodiments, a quantitative basis for defining the manifold 902 is calculated using Hotelling's T2 statistics, which provides a statistical measure of the multivariate distance of each observed parameter from the center or origin of the data set transformed into the principal component space. In alternate embodiments, other known statistical measures may be employed to define the manifold 902. In FIG. 9, the manifold 902 represents an example corresponding to a 95% confidence level. That is, for an ESP performance coordinate falling within the manifold 902, it is 95% likely that the ESP 210 is in a normal mode of operation. Further, it is noted that the manifold 902 may be defined using a distance from the origin 904 of the principal component space as a function of the direction from the origin 904. As shown, the manifold distance from the origin 904 to the manifold 902 boundary in the positive PC1 direction is relatively short, due to the fact that PC1 is positively influenced by a large number of the observed parameters. That is, changes in these parameters have a large effect on the value of PC1 in the positive direction, and thus the tolerance in this direction (i.e., the distance from the origin 904 to the manifold 902 boundary) is more stringent with regards determining whether the ESP 210 is in a normal mode of operation. As an example, a weighted Euclidean distance can be used with weights determined by the fraction of total explained variance corresponding to each individual principal component, as shown in FIG. 5.

As explained above, once a set of components is identified that captures a suitable total variance of the observable parameters (e.g., this threshold may change based on customer requirements), ESP 210 operation continues, for example in a downhole or other environment. During this ESP 210 operation, data indicating the observable parameters continues to be transformed into the reduced components and, in particular, the identified components that capture a suitable total variance of the parameters. In some embodiments, fewer parameters may be observed during this subsequent operation of the ESP 210 than were used in determining the initial components or the identified components. For example, 11 parameters P1-P11 may have been used to generate the initial components and/or the identified components. However, because these parameters may have been generated in a controlled environment, some parameters could be unavailable or difficult to acquire in an alternate environment, for example downhole, and thus subsequent monitoring of ESP 210 operation only includes certain of the observable parameters. In this case, the proposed algorithm may be reapplied on an initial data comprising only operationally observable physical parameters to redefine the mapping into an updated set of principal components and determine an updated manifold of ESP 210 normal operation in a reduced component space. Of course, in other embodiments, the same parameters used to generate the initial components and/or the identified components are also available and thus detected or received during subsequent ESP 210 operation, for example downhole.

Figure 10:
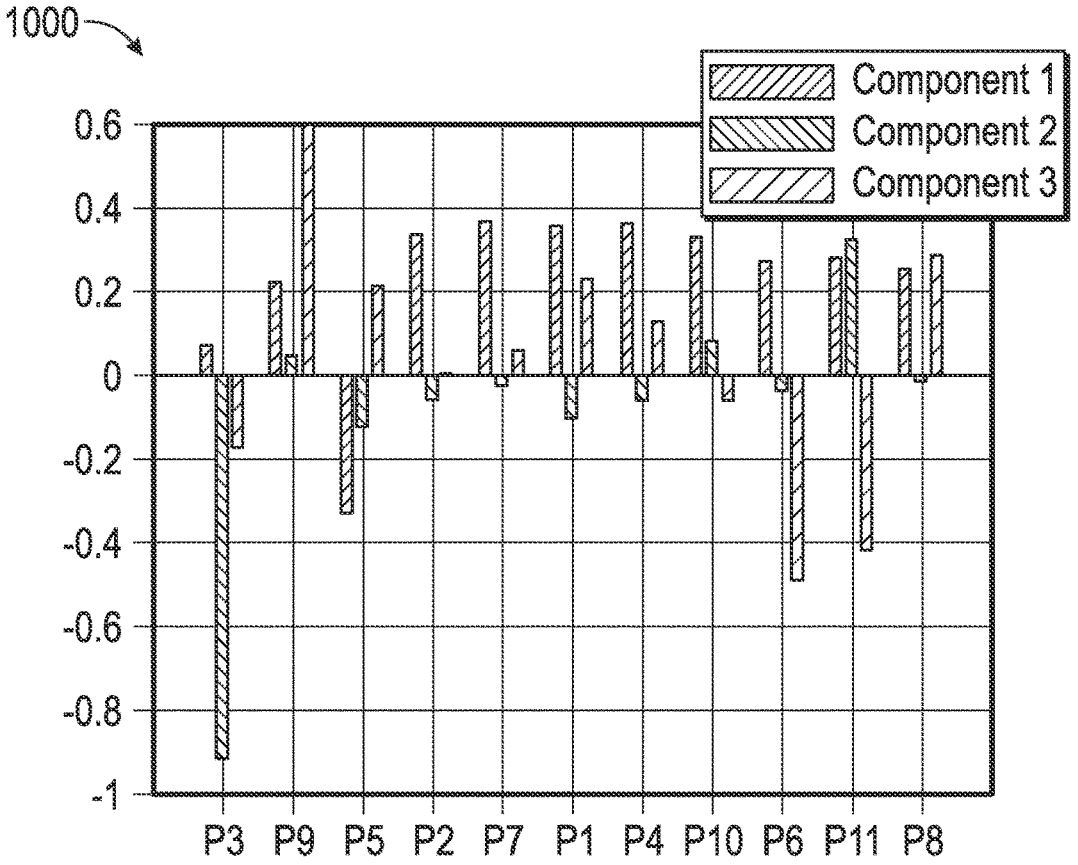
FIG. 10 illustrates observed parameter coefficient values for each of three identified components in accordance with various embodiments of the present disclosure.

FIG. 10 demonstrates the coefficients 1000 for each of the identified components PC1, PC2, PC3 from the above examples. The orthonormal transformation of observable parameters to the identified components is illustrated by these corresponding coefficients 1000. For each new observation during subsequent ESP 210 operation, a distance from a coordinate representing the observation in the component space to the origin of the component space is calculated. Based on this distance, a determination is made as to whether the ESP 210 performance deviates from a normal operation. As explained above, the distance that specifies whether the ESP 210 is in a normal mode of operation may be dependent on the direction from the origin of the component space. In certain embodiments, a corresponding T2 distance for the center of the data set is calculated and the determination is made whether the performance of the ESP is deviating from the normal mode of operation. In case the deviation is identified, a corresponding alert may be generated. Further, in some embodiments, multiple clusters or manifolds (e.g., distance functions) may be constructed that indicate varying warning levels for the ESP 210 performance. For example, an intermediate manifold may define a region in which ESP 210 performance may be degrading, but is not degrading critically. An outer manifold, however, defines a region in which an observed ESP 210 performance point that falls outside the outer manifold indicates that ESP 210 performance is in a greater risk of degrading to failure. In this case, the generated alerts may indicate the corresponding levels of assessed ESP 210 performance based on the various manifolds.

In a further embodiment, the determination of deviation from the normal mode of ESP 210 operation can also be made based on a hypothesis-testing approach. A null hypothesis (H0) is constructed, which specifies a normal mode of operation, and an appropriate probability model is constructed for the observations therefrom. In some cases, this is a normal distribution centered on a learned manifold 902 determined above, or some other distribution as appropriate, based on the operation mode of the ESP 210 and measurement physics. An alternate hypothesis (H1) may be constructed that indicates a deviation from the normal mode of ESP 210 operation, along with a corresponding probability model for such a deviation. Based on new or subsequent observations of parameters, a test is performed between the null hypothesis H0 and alternate hypothesis H1, by comparing the likelihood functions computed for the new or subsequent observations of parameters under the probability model for each hypothesis H0, H1. The likelihood ratio is compared to a threshold and the appropriate hypothesis declared based on the outcome. In some embodiments, the choice of threshold may be dictated by the need to control the probability (or frequency) of false alarms that can be tolerated. In these cases, a statistical quantification of the confidence level of a departure from normal operations is also provided.

In yet further embodiments, a manifold 902 may be defined based on experimental observation. For example, data indicative of the observable parameters may be logged (e.g., stored in memory) while the ESP 210 is known to be in a normal mode of operation. In some cases, variables relating to the ESP 210 operation such as drive frequency, fluid viscosity or density, and the like may be altered to vary the observed parameters while ensuring that the ESP 210 is in a known normal mode of operation. As above, the observed parameters are mapped to the identified component or principal component set, which generates a performance coordinate in the component or principal component space. In this way, a region in the component or principal component space is defined by experimentally-derived ESP 210 performance coordinates that corresponds to a normal mode of operation of the ESP 210. In certain cases, once the region or manifold 902 is suitably defined, operation of the ESP 210 that generates performance coordinates outside of the region or manifold 902 may indicate a deviation from the normal mode of operation in excess of a predetermined threshold.

In another embodiment, classification or clustering (such as k-means clustering, Bayesian hierarchical clustering) can be performed to identify clusters (in principal component space) of observations representing normal mode of ESP operation. Distance-based clustering approaches such as k-means clustering require a predefined number of clusters and a prescribed measure (distance metric) to be provided. Alternatively, in Bayesian hierarchical clustering (BHC), degree of similarity is expressed in probabilistic terms by determining the probability that the elements of any two clusters are generated based on the same probability distribution and, therefore, can be merged into the same cluster. Once the clusters are defined, the chosen classification algorithm determines the degree of similarity between the new observation and the clusters of normal mode of ESP operation.

In some embodiments, when the data indicative of the observed parameters evolves over time and may contain a temporary correlation, a multi-way PCA or other component analysis may be employed to account for these correlations. Finally, a non-linear or kernel PCA may be used in lieu of traditional linear PCA if the underlying relation is expected to be highly non-linear.

Figure 11:
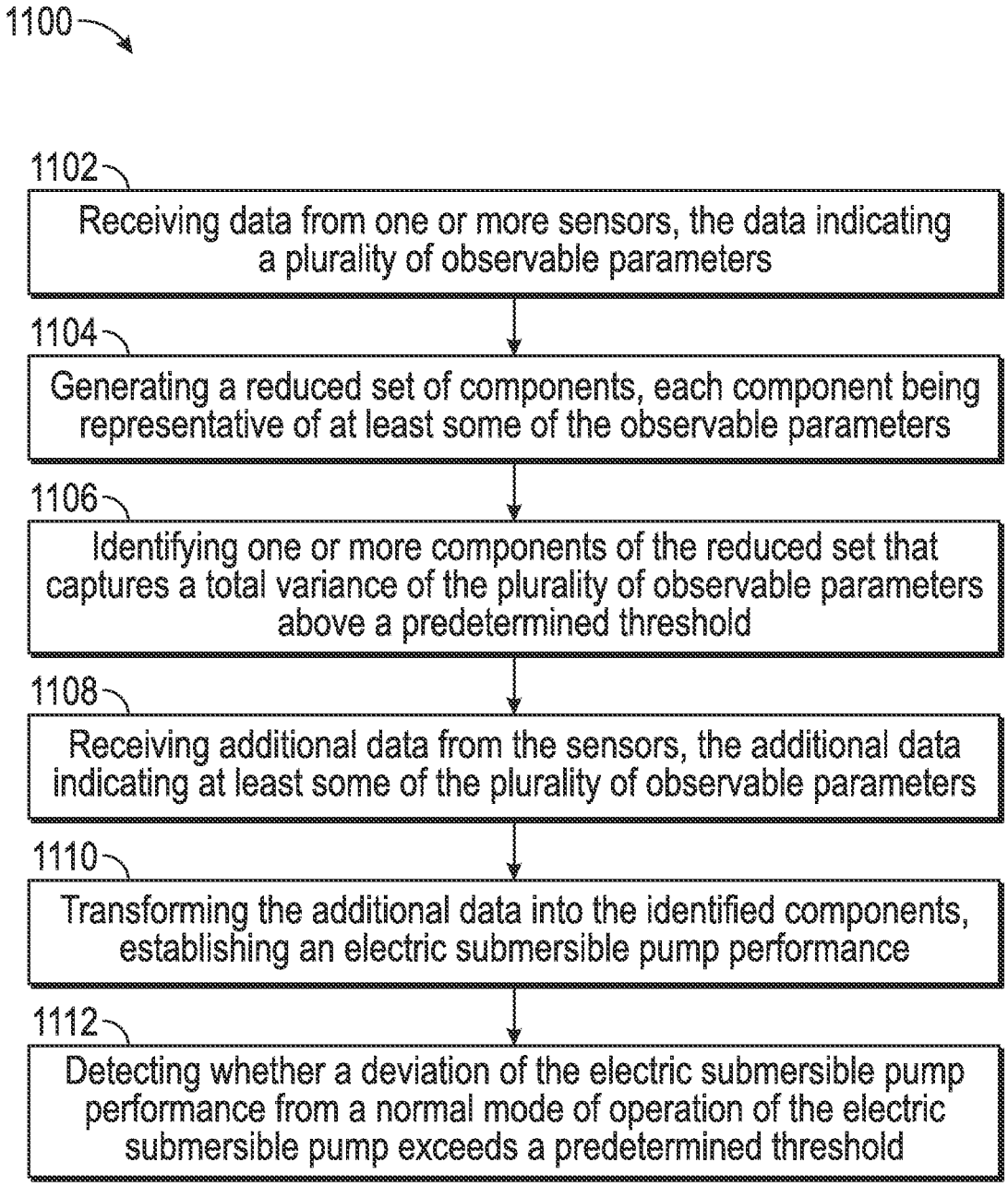
FIG. 11 illustrates a flowchart of a method for monitoring performance of a electric submersible pump in accordance with various embodiments of the present disclosure.

Turning now to FIG. 11, a method 1100 for monitoring an ESP 210 is shown in accordance with various embodiments. The method 1100 begins in block 1102 with receiving data from one or more sensors 216, 220 that indicates a plurality of observable parameters. In the foregoing discussion, a non-limiting exemplary list of 11 such parameters was provided. The method 1100 continues in block 1104 with generating a reduced set of components, where each component is representative of at least some of the observable parameters. The reduced set of components is defined as having a dimensionality less than the number of observable parameters. For example, the 11 observed parameters may be reduced to a set of three components. Based on the generated set of components, the method 1100 continues in block 1106 with identifying one or more components that capture a total variance of the observable parameters above a predetermined threshold. The predetermined threshold may be set by customer preference. In some cases, the components of the set are ranked according to their contribution to the total variance, and components are selected starting with the largest contribution to the total variance until the combined variance of the selected components is above the predetermined threshold. In various embodiments, blocks 1102, 1104, 1106 are carried out in a controlled environment where the ESP 210 is known to be in a normal mode of operation.

Subsequently, the ESP 210 may be deployed in a different environment, such as downhole, although this is not necessary to all embodiments of the present disclosure. In block 1108, additional data is received from the sensors 216, 220 that indicates at least some of the observable parameters described above. In block 1110, the additional data is transformed into the identified components from block 1106, which establishes an ESP 210 performance coordinate in the component space. As explained above, the space may be a principal component space. Based on the performance coordinate in the component space, the method 1100 continues in block 1112 with detecting whether a deviation of the ESP 210 performance coordinate from a normal mode of operation of the ESP 210 exceeds a predetermined threshold. Whether the deviation exceeds a predetermined threshold may be based on constructing a manifold 902 as described previously and determining whether the ESP 210 performance coordinate lies in the component space within the manifold 902 or outside the manifold 902. In some cases, an indication of the mode of operation of the ESP 210 is generated based on the method 1100.

Some of the methods and processes described above, including processes, as listed above, can be performed by a processor (e.g., processor 290). The term "processor" should not be construed to limit the embodiments disclosed herein to any particular device type or system. The processor may include a computer system. The computer system may also include a computer processor (e.g., a microprocessor, microcontroller, digital signal processor, or general purpose computer) for executing any of the methods and processes described above.

The computer system may further include a memory such as a semiconductor memory device (e.g., a RAM, ROM, PROM, EEPROM, or Flash-Programmable RAM), a magnetic memory device (e.g., a diskette or fixed disk), an optical memory device (e.g., a CD-ROM), a PC card (e.g., PCMCIA card), or other memory device.

Some of the methods and processes described above, as listed above, can be implemented as computer program logic for use with the computer processor. The computer program logic may be embodied in various forms, including a source code form or a computer executable form. Source code may include a series of computer program instructions in a variety of programming languages (e.g., an object code, an assembly language, or a high-level language such as C, C++, or JAVA). Such computer instructions can be stored in a non-transitory computer readable medium (e.g., memory) and executed by the computer processor. The computer instructions may be distributed in any form as a removable storage medium with accompanying printed or electronic documentation (e.g., shrink wrapped software), preloaded with a computer system (e.g., on system ROM or fixed disk), or distributed from a server or electronic bulletin board over a communication system (e.g., the Internet or World Wide Web).

Alternatively or additionally, the processor may include discrete electronic components coupled to a printed circuit board, integrated circuitry (e.g., Application Specific Integrated Circuits (ASIC)), and/or programmable logic devices (e.g., a Field Programmable Gate Arrays (FPGA)). Any of the methods and processes described above can be implemented using such logic devices.

Using the various embodiments of monitoring an ESP 210 described herein, a large number of observable parameters may be reduced to a set of components that still demonstrates a large contribution to the total variance of the parameters, but is computationally simpler to feasibly process. By contrast, conventional performance metrics are based upon relatively few parameters and interrelation between parameters is not generally considered. As a result of the disclosed embodiments, parameters that were previously ignored or thought insignificant in predicting ESP 210 performance—such as those parameters not utilized in conventional performance curves as in FIG. 1—may be considered in determining ESP 210 performance. Similarly, deviations in parameter value that are not be captured by conventional performance curves may be considered by embodiments of the present disclosure as they are included in the determined components, leading to an enhanced ability to predict ESP 210 performance without unduly increasing processing requirements.

Although only a few example embodiments have been described in detail above, those skilled in the art will readily appreciate that many modifications are possible in the example embodiments without materially departing from the electrical connector assembly. Features shown in individual embodiments referred to above may be used together in combinations other than those which have been shown and described specifically. Accordingly, all such modifications are intended to be included within the scope of this disclosure as defined in the following claims.

The embodiments described herein are examples only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims.

What is claimed is:

1. A method comprising:

receiving data, the data indicating a plurality of observable parameters, with a corresponding observable parameter dimensionality, for normal performance of an electric submersible pump;

performing Principal Component Analysis (PCA) using the received data to generate a set of components in a component space, and each of the components being representative of at least some of the plurality of observable parameters and the component space having a dimensionality less than the observable parameter dimensionality;

identifying one or more components of the set of components that captures a total variance of the plurality of observable parameters above a predetermined threshold and that defines a reduced component space having a dimensionality less than the component space;

using at least the identified one or more components, constructing a manifold that represents the normal performance of the electric submersible pump in the reduced component space;

receiving data from one or more sensors, the data from the one or more sensors indicating the plurality of observable parameters for actual performance of the electric submersible pump;

transforming the received data from the one or more sensors into the identified one or more components in the reduced component space to establish a representation of the actual performance of the electric submersible pump; and detecting a deviation in the actual performance of the electric submersible pump from the normal performance of the electric submersible pump by comparing at least one of the identified one or more components in the reduced component space that establish the representation of the actual performance of the electric submersible pump to the manifold in the reduced component space that represents the normal performance of the electric submersible pump.

2. The method of claim 1 where the identified one or more components comprise linear combinations of at least some of the plurality of observable parameters.

3. The method of claim 1 wherein the detecting the deviation comprises: determining that the representation of the actual performance of the electric submersible pump belongs to the constructed manifold.

4. The method of claim 1 wherein constructing the manifold comprises: logging the data indicative of the observable parameters while the electric submersible pump is known to be in a normal mode of operation that corresponds to the normal performance; and experimentally defining a region within the reduced component space that corresponds to the normal mode of operation that corresponds to the normal performance, wherein coordinates in the reduced component space outside of the region indicate that the deviation in the actual performance exceeds a total variance represented by the manifold.

5. The method of claim 4 wherein the experimentally defining the region within the reduced component space that corresponds to the normal mode of operation of the electric submersible pump comprises applying a clustering algorithm.

6. The method of claim 5 wherein the clustering algorithm is at least one of k-means clustering or Bayesian hierarchical clustering algorithm.

7. The method of claim 1 wherein detecting the deviation comprises using a statistical, hypothesis-testing approach.

8. The method of claim 1 wherein the identifying the one or more components further comprises: ranking the components in a decreasing order of their contribution to variance of the plurality of observable parameters; and beginning to select components until a sum of the variance of the selected components exceeds the predetermined threshold.

9. The method of claim 1 further comprising: generating an indication of the detection and, based on the indication of the detection, issuing a control instruction that controls the electric submersible pump.

10. The method of claim 1 wherein the plurality of observable parameters comprise a motor winding temperature and a protector temperature.

11. The method of claim 1 wherein constructing the manifold comprises utilizing Hotelling's $T^2$ statistics.

12. The method of claim 1 wherein constructing the manifold comprises utilizing a confidence level to define a boundary between the normal performance and non-normal performance.

13. A system comprising:

a processor operatively coupled to memory that stores processor-executable instructions to instruct the system to:

receive data, the data indicating a plurality of observable parameters, with a corresponding observable parameter dimensionality, for normal performance of an electric submersible pump;

perform Principal Component Analysis (PCA) using the received data to generate a set of components in a component space, each of the components being representative of at least some of the plurality of observable parameters and the component space having a dimensionality less than the observable parameter dimensionality;

identify one or more components of the set of components that captures a total variance of the plurality of observable parameters above a predetermined threshold and that defines a reduced component space having a dimensionality less than the component space;

using at least the identified one or more components, construct a manifold that represents the normal performance of the electric submersible pump in the reduced component space;

receive data from one or more sensors, the data from the one or more sensors indicating the plurality of observable parameters for actual performance of the electric submersible pump;

transform the received data from the one or more sensors into the identified one or more components in the reduced component space to establish a representation of the actual performance of the electric submersible pump; and detect a deviation in the actual performance of the electric submersible pump from the normal performance of the electric submersible pump by comparing at least one of the identified one or more components in the reduced component space that establish the representation of the actual performance of the electric submersible pump to the manifold in the reduced component space that represents the normal performance of the electric submersible pump.

14. The system of claim 13 where the identified one or more components comprise linear combinations of a least some of the plurality of observable parameters.

15. The system of claim 13 wherein the processor detects the deviation via a determination that the representation of the actual performance of the electric submersible pump belongs to the constructed manifold.

16. The system of claim 13 wherein the memory logs the data indicative of the observable parameters while the electric submersible pump is known to be in a normal mode of operation; wherein the processor experimentally defines a region that corresponds to the normal mode of operation of the electric submersible pump, wherein coordinates outside of the region indicate that the deviation in the actual performance exceeds a total variance represented by the manifold.

17. The system of claim 13 wherein the processor applies a statistical, hypothesis-testing approach to detect the deviation.

18. The system of claim 13 wherein the processor ranks the components in a decreasing order of their contribution to variance of the plurality of observable parameters and selects components until a sum of the variance of the selected components exceeds the predetermined threshold.

19. The system of claim 13 wherein the processor causes a display to generate an indication of the detection and, based on the detection, issues a control instruction that controls operation of the electric submersible pump.

20. A non-transitory computer-readable medium containing instructions that, when executed by a processor, cause the processor to:

receive data, the data indicating a plurality of observable parameters, with a corresponding observable parameter dimensionality, for normal performance of an electric submersible pump;

perform Principal Component Analysis (PCA) using the received data to generate a set of components in a component space, each of the components being representative of at least some of the plurality of observable parameters and the component space having a dimensionality less that the observable parameter dimensionality;

identify one or more components of the set of components that captures a total variance of the plurality of observable parameters above a predetermined threshold and that defines a reduced component space having a dimensionality less than the component space;

using at least the identified one or more components, construct a manifold that represents the normal performance of the electric submersible pump in the reduced component space;

receive data from one or more sensors, the data from the one or more sensors indicating the plurality of observable parameters for actual performance of the electric submersible pump;

transform the received data from the one or more sensors into the identified one or more components in the reduced component space to establish a representation of the actual performance of the electric submersible pump; and detect a deviation in the actual performance of the electric submersible pump from the normal performance of the electric submersible pump by comparing at least one of the identified one or more components in the reduced component space that establish the representation of the actual performance of the electric submersible pump to the manifold in the reduced component space that represents the normal performance of the electric submersible pump.

21. The non-transitory computer-readable medium of claim 20 where the one or more identified components comprise linear combinations of at least some of the plurality of observable parameters.

22. The non-transitory computer-readable medium of claim 20 wherein the instructions cause the processor to: determine if the representation of the actual performance belongs to the constructed manifold.

* * * * *